US008012329B2

(12) United States Patent
Trice et al.

(10) Patent No.: US 8,012,329 B2
(45) Date of Patent: Sep. 6, 2011

(54) DIMENSIONAL CONTROL IN ELECTROFORMS

(75) Inventors: Jennifer L. Trice, Hugo, MN (US); Charles N. DeVore, Hugo, MN (US); James R. Starkey, Menomonie, WI (US)

(73) Assignee: 3M Innovative Properties Company, Saint Paul, MN (US)

( * ) Notice: Subject to any disclaimer, the term of this patent is extended or adjusted under 35 U.S.C. 154(b) by 786 days.

(21) Appl. No.: 12/117,880

(22) Filed: May 9, 2008

(65) Prior Publication Data

US 2009/0277794 A1 Nov. 12, 2009

(51) Int. Cl.
*C25D 1/00* (2006.01)

(52) U.S. Cl. ..... 205/67; 205/70

(58) Field of Classification Search ..... 205/67, 205/70

See application file for complete search history.

(56) References Cited

U.S. PATENT DOCUMENTS

| | | | |
|---|---|---|---|
| 3,959,109 | A | 5/1976 | Hambling et al. |
| 4,043,876 | A | 8/1977 | Hambling et al. |
| 4,402,571 | A | 9/1983 | Cowan et al. |
| 4,501,646 | A | 2/1985 | Herbert |
| 4,575,406 | A | 3/1986 | Slafer |
| 4,781,799 | A | 11/1988 | Herbert, Jr. et al. |
| 5,385,660 | A | 1/1995 | Herbert et al. |
| 5,807,472 | A | 9/1998 | Hendrix et al. |
| 2004/0045419 | A1 | 3/2004 | Bryan et al. |
| 2005/0187521 | A1 | 8/2005 | Fleming et al. |
| 2005/0206034 | A1 | 9/2005 | Yokoyama et al. |
| 2006/0225463 | A1 | 10/2006 | Sugimoto et al. |
| 2006/0234605 | A1 | 10/2006 | Bryan et al. |
| 2007/0191761 | A1 | 8/2007 | Boone et al. |
| 2007/0231541 | A1 | 10/2007 | Humpal et al. |
| 2007/0235902 | A1 | 10/2007 | Fleming et al. |
| 2008/0023446 | A1 | 1/2008 | Trice et al. |

FOREIGN PATENT DOCUMENTS

JP 08333691 A * 12/1996

OTHER PUBLICATIONS

Inck Nickel Electroforming Processes and Application, 1991, pp. 1-38.

* cited by examiner

*Primary Examiner* — Luan V Van

(57) ABSTRACT

A method includes placing a conductive mold in a first bath of electroforming solution, the solution including metal and having a selected temperature. A current is provided to the electroforming solution so that metal deposits onto the mold, thereby forming an electroformed element on the mold, the electroformed element and the mold being a composite assembly. The method further includes removing the composite assembly from the electroforming solution and transferring the composite assembly to a second bath having the same selected temperature. Thereafter, the electroformed element is separated from the mold while the composite assembly is in the second bath.

20 Claims, 6 Drawing Sheets

DIMENSIONAL CONTROL IN ELECTROFORMS

BACKGROUND

Generally, this disclosure relates to forming a continuous microstructured layer by electrolitic deposition in an electrolitic bath.

Electroforming is a process in which a mold is coated with a metal by using the mold as a cathode, to form a metal layer of the desired shape, after which the mold is removed. Suitable metals capable of being deposited by electroforming include nickel, copper, cobalt, iron, gold, silver, platinum, chromium, palladium, rhodium, lead, and the like, and alloys thereof. Nickel is particularly suitable because it fulfills many engineering requirements for physical and mechanical properties, including strength, toughness, and corrosion resistance. Moreover, the physical and mechanical properties of the electroformed component can be varied by changing plating conditions or the composition of the electroforming solution, by alloying with other elements, and by incorporating particles and fibers within the metal matrix, for example.

Where the mold is not expendable (such as by dissolving the mold from the electroformed element), an electroformed element must be removed from the mold. One method of mechanical removal involves the use of impact, such as by a sudden pull or hammer blow. Another method utilizes prying the electroformed element from the mold with a sharp tool. This technique is inexact and can lead to stress marks due to bending in the electroformed element and potentially damage the mold. Another method uses gradual force, such as force applied by a hydraulic ram to push, or force applied by a wheel-puller to pull, the pieces apart.

Other parting methods involve changes in temperature. One method uses differential coefficients of thermal expansion of the electroformed element and mold materials and involves cooling, for example with a mixture of dry ice and acetone. This works best if the mold has a lower coefficient of expansion than the electroformed element. On withdrawal from the cold bath, the electroformed element expands faster than the mold, thereby permitting separation. Another method involves heating, such as with a torch or hot water or oil bath, either to melt or soften a parting compound or to take advantage of a difference in coefficients of expansion between mold and electroformed element.

While changes in temperature may be useful for separating an electroformed element from a mold, such changes may adversely affect dimensional control. In one example, nickel plating is used and is deposited at around 55° C. The mold material is typically copper based, such as brass. Linear thermal expansion coefficients for the mold material and the plating differ: 0.0208 mm/mC for the brass (alloy 280) mold and 0.0133 mm/mC for the nickel plating. After deposition at 55° C., the combined electroformed mold is typically allowed to cool to room temperature, around 22° C. Over a length of 0.5 m, the length change is about 3.75 microns per degree of temperature change and over the 23 degree temperature drop to room temperature, the length change is about 86.25 microns. This is much greater than the acceptable tolerance for controlling positional accuracy in some applications. In addition, the fine pattern in the master tool is typically on a pitch spacing of 200-500 microns and the angled features are susceptible to locking. The term "pitch" refers to the distance between two adjacent features in a piece. Shifting the pattern, relatively, between the master tool and the electroformed element may cause permanent deformation of the features of the electroformed element.

SUMMARY

In one aspect, a method includes placing a conductive mold in a first bath of electroforming solution, the solution including metal and having a selected temperature. A current is provided to the electroforming solution so that metal deposits onto the mold, thereby forming an electroformed element on the mold, the electroformed element and the mold being a composite assembly. The method further includes removing the composite assembly from the electroforming solution and transferring the composite assembly to a second bath having the same selected temperature. Thereafter, the electroformed element is separated from the mold while the composite assembly is in the second bath.

In another aspect, a method includes providing a conductive mold comprising a plurality of bores and masking off each of the plurality of bores, and placing the mold in a first bath of electroforming solution, wherein the solution includes metal and has a selected temperature. A current is provided to the electroforming solution so that metal deposits onto the mold, thereby forming an electroformed element on the mold, the electroformed element and the mold being a composite assembly. The composite assembly is removed from the electroforming solution, sprayed with a fluid having the same selected temperature, and transferred to a second bath of fluid having the same selected temperature. The electroformed element is separated from the mold while the composite assembly is in the second bath. The separating step includes gradually advancing a plurality of separation mechanisms through at least some of the plurality of bores in the mold to push the electroformed element away from the mold.

This Summary is provided to introduce a selection of concepts in a simplified form that are further described below in the Detailed Description. This Summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

Figure 1A:
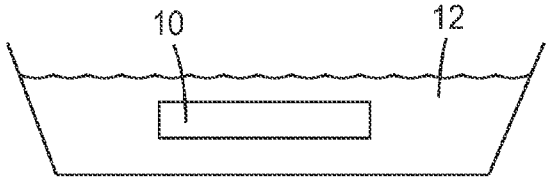
FIG. 1A is a schematic sectional view of a mold in a bath of electroforming solution.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure. Moreover, the figures may not be drawn to scale.

DETAILED DESCRIPTION

This disclosure describes a method of controlling pitch accuracy in an electroforming process. Electroforming involves building up an electrolytic plating onto a surface and releasing it to create a part of the opposite geometric generation as the master tool. Electroforming is a fundamental step in fabrication of some microreplication tooling. Applications include diamond grade sheeting and brightness enhancement films used in plasma television display panels, for example.

Flat tooling, rather than mandrel molds, may be used. Molds that are in the shape of the final product are particularly suitable for applications where dimensional control and structural integrity and accuracy are important. For example, film used in screens for televisions, monitors and display devices are generally planar in use. Therefore, producing these films on flat molds can yield more accurate structure formation than using a cylindrical mold such as a mandrel. Moreover, in other embodiments, molds of other shapes may be used in the construction of shaped products such as automobile tail light lenses, for example. In exemplary embodiments, it is desirable to control the positional accuracy within single digit microns (±5 microns) over a distance of approximately one meter. Changes in the electrochemical plating process, in order to manage residual stresses, are also important to pitch control. However, the disclosed process is primarily a means of mechanically managing stresses created by differential thermal expansion between the tooling material, typically brass or copper, and the electroformed element, which is typically nickel.

In an exemplary method, the electroformed element is deposited at about 55° C. and is not allowed to cool until after it is released from the mold. A temperature controlled water bath is set up near the plating tank and maintained at 55° C., the same temperature as the plating tank. Following plating, the plated mold is transferred into the water bath for separation of the electroformed element from the mold. The constant temperature allows the mold and the electroformed element to stay in the same stress state as when they were deposited, which is ideally near zero stress.

In an exemplary embodiment, the mold is about 5 mm thick. In some embodiments, the electroformed element is thinner than the mold; in other embodiments, the electroformed element is of similar thickness as the mold. To separate the electroformed element from the mold in an exemplary embodiment, regularly spaced threaded holes and jackscrews, screws, or the like are used to push the electroformed element off of the mold. The screws are incrementally adjusted to evenly lift the electroformed element away from the master tooling, minimizing bending and stress. Once in the temperature controlled water bath, the time may be taken to gradually separate the electroformed element and mold without adverse effect.

Another advantage of the water bath is that any electroforming solution on the parts is washed away or at least diluted and therefore does not stain the parts. Staining is a surface discontinuity caused by plating solution remaining on the mold face that carries over as a surface roughness onto a final molded product.

FIG. 1A is a schematic sectional view of a mold 10 in a bath of electroforming solution 12. Copper and brass may be used in exemplary embodiments as mold materials in permanent, conductive molds 10. These materials are less expensive than stainless steel, are relatively easy to machine, and are receptive to use with intricately engraved or textured surfaces. However, in conventional processes, removal of the electroformed element 14 (shown in FIG. 1B) from a mold 10 of these materials may be difficult in the absence of a parting film.

Electroforming solutions 12 commonly comprise a metal such as nickel and include the Watts solution and conventional and concentrated nickel sulfamate solutions with and without additives. Nickel fluoborate solutions can also be used. The advantages of nickel electroforming from sulfamate solutions are the low internal stress of the deposits and the high rates of deposition that are possible, especially from a concentrated solution. The formulations of exemplary electroforming solutions 12 are given in Table 1.

TABLE 1

Nickel Electroforming Solutions And Typical Properties of the Deposits

| | Watts Nickel | Conventional Sulfamate | Concentrated Sulfamate |
|---|---|---|---|
| | Electrolyte Composition, g/l | | |
| $NiS0_4\ 6H_20$ | 225 to 300 | | |
| $Ni(S0_3NH_2)_24H_20$ | | 315 to 450 | 500 to 650 |

TABLE 1-continued

| Nickel Electroforming Solutions And Typical Properties of the Deposits | | | |
|---|---|---|---|
| | Watts Nickel | Conventional Sulfamate | Concentrated Sulfamate |
| $NiCl_2$ $6H_20$ | 37 to 53 | 0 to 22 | 5 to 15 |
| $H_3B0_3$ | 30 to 45 | 30 to 45 | 30 to 45 |
| | | Operating Conditions | |
| Temperature, ° C. | 44 to 66 | 32 to 60 | Normally 60 or 70 |
| Agitation | Air or mechanical | Air or mechanical | Air or mechanical |
| Cathode Current Density, A/dm$^2$ | 3 to 11 | 0.5 to 32 | Up to 90 |
| Anodes | Nickel | Nickel | Nickel |
| pH | 3.0 to 4.2 | 3.5 to 4.5 | 3.5 to 4.5 |
| | | Mechanical Properties | |
| Tensile Strength, MPa | 345 to 485 | 415 to 620 | 400 to 600 |
| Elongation, % | 15 to 25 | 10 to 25 | 10 to 25 |
| Vickers Harness, 100 gram load | 130 to 200 | 170 to 230 | 150 to 250 |
| Internal Stress, MPa | 125 to 185 (tensile) | 0 to 55 (tensile) | Zero stress can be obtained at various combinations of current density and temperature. |

The Watts solution contains nickel sulfate, nickel chloride and boric acid. It yields nickel deposits that are matte in appearance and that are stressed in tension. Nickel sulfate is the main source of nickel ions in the Watts solution. Nickel chloride increases solution conductivity and has a beneficial effect on the uniformity of metal distribution at the cathode. Boric acid acts as a buffer to control pH at the cathode-solution interface.

Anti-pitting agents (wetting agents) are useful for avoiding pitting due to the clinging of air and hydrogen bubbles. To minimize surface flaws such as pitting, the surface tension of the electroforming solution 12 in an exemplary embodiment is adjusted to, for example, about 28 dynes per square centimeter. The surface tension of the electroforming solution 12 may be maintained within this range by adding an anionic surfactant such as sodium lauryl sulfate, sodium alcohol sulfate (Duponol 80, available from E.I. duPont de Nemours and Co., Inc.), sodium hydrocarbon sulfonate (Petrowet R, available from E.I. duPont de Nemours and Co., Inc.), Snap-am (available from MacDermid) and the like.

Figure 1B:
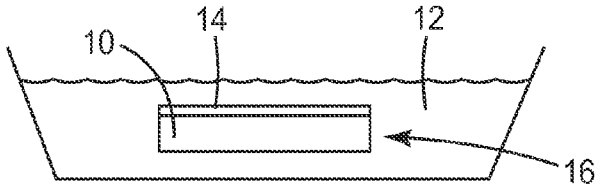
FIG. 1B is a schematic sectional view of the mold of FIG. 1A having an electroformed element deposited thereon.

FIG. 1B is a schematic sectional view of the mold 10 of FIG. 1A having an electroformed element 14 deposited thereon within a conventional nickel sulfamate electroforming solution 12. Together, electroformed element 14 and mold 10 form composite assembly 16. In an exemplary embodiment, electroforming solution 12, in the steps illustrated in FIGS. 1A and 1B, is maintained at a temperature of about 55° C. (131° F.) to minimize stress in the electroformed element. In other embodiments, the temperature of electroforming solution 12 is between about 115° F. (46° C.) and about 140° F. (60° C.). At a temperature of electroforming solution 12 below about 115° F., high stress levels may cause electroformed element 14 to bend and lose dimensional stability. At a temperature above about 140° F., electroforming solution 12 may break down.

The internal stress of the electroformed element 14 can also be controlled by use of organic additives. Typical stress reducers include saccharin, paratoluene sulfonamide, metabenzene disulfonate, and 1-3-6 sodium naphthalene trisulfonate. All of these organic stress-reducing agents introduce sulfur into nickel deposits; this may limit the temperature at which the electroformed element 14 can be used. Nickel electrodeposits with small amounts of sulfur become embrittled when exposed to temperatures above 200° C. The exact temperature of embrittlement depends on the sulfur content, the duration at the elevated temperature and other factors. Control of internal stress by use of organic additives typically requires an optimum level of the additive, regular replenishment as it is consumed, and frequent (or continuous) carbon treatment to control the concentration of decomposition products which form as a result of reduction of the additive at the cathode.

For example, saccharine in a concentration of more than about 2 grams per liter causes nickel oxide to form as a green powder rather than as a nickel deposit on a mold. At concentrations of about 1 gram per liter, the deposited nickel layer will often become so compressively stressed that the stress will be relieved during deposition, causing the electroformed element 14 to be permanently wrinkled.

Conventional nickel sulfamate solutions, as used in exemplary embodiments, are analogous to Watts solutions in which the nickel sulfate is replaced with nickel sulfamate. The internal stress is lower than in the Watts solution, as indicated by the information at the bottom of Table 1. The zero stress level may be obtained by maintaining the solution in a high state of purity and by eliminating the nickel chloride. To assure efficient dissolution of nickel anode materials in the absence of chlorides, sulfur-activated nickel anode materials, such as S-Rounds electrolytic nickel or S-Nickel pellets from International Nickel Company may be used.

A stable tensile stress can be maintained in conventional nickel sulfamate solutions by including nickel chloride in the formulation, by using an adequate anode area (1.5 to 2 times the area of the cathode), and by using a fully-active nickel anode material to maintain the potential on the anode basket as low as possible, thus avoiding oxidation of the sulfamate anion. Under these conditions, the stress level normally is between 35 and 55 MPa (5000 to 8000 psi) tensile for a well-worked solution.

A phenomenon that apparently only occurs in sulfamate solutions is anodic oxidation of the anion to form species that diffuse to the cathode, where they are reduced. In some cases, this results in incorporation of sulfur, which acts to lower internal stress and brighten the deposit. This occurs, for example, at insoluble primary or auxiliary anodes or at nickel anodes that are operating at high potentials.

A concentrated nickel sulfamate process, Ni-Speed™, was developed by Inco Europe Limited. It permits the deposition of nickel at high rates and at low stress levels in the deposit. It is particularly useful for electroforming where zero-stress conditions are required to produce perfectly flat electroforms and where thick deposits may be built up rapidly. Because low to zero-stress conditions can be achieved without organic additives, there is no incorporation of sulfur and the deposits do not become embrittled when heated above 200° C.

The concentrated nickel sulfamate contains 600 g/l nickel sulfamate. Nickel-cobalt alloys can be deposited from concentrated nickel sulfamate solutions with controlled internal stresses. The cobalt in solution can be maintained by the addition of cobalt sulfamate or by using electrolytic cobalt anodes connected to a separate power supply alongside the nickel anodes. The codeposition of cobalt increases the hardness and strength and enhances the high temperature properties of the deposits. The cobalt content of the deposit rises with increasing amounts of cobalt in solution and declines as the current density increases. As the cobalt content of the solution is increased, the hardness of the deposit increases to a maximum value. The peak occurs at 35 per cent cobalt in the deposit which corresponds to about 6 g/l cobalt in solution. The internal stress of the deposit increases with current density and also with cobalt content of the solution.

Nickel-cobalt alloys can be deposited from conventional nickel sulfamate solutions and from nickel sulfate-based solutions, but the deposition of the alloys from the concentrated solution provides a means to control the internal stress without the use of organic additives.

The use of leveling agents, such as 2 butyne 1:4 diol, can improve metal distribution on the mold by suppressing the growth of nodules and by preventing the formation of a plane of weakness when electroforming into a corner. In general, leveling agents increase internal stress in the tensile direction. In the case of deposition of nickel or nickel-cobalt alloys, it is possible to control the increase that results from the use of the leveling agent and achieve acceptable levels of internal stress. The initial concentration of butyne diol suggested for a concentrated solution with 1.25 g/L cobalt is about 20 mg/L with a replenishment rate of 0.5 mg/Ah at a current density of 3 $A/dm^2$. Although the breakdown products formed by organic additives generally increase internal stress, continuous filtration through carbon removes only the breakdown products in the case of butyne diol and the stress can be controlled.

The mechanical properties of electroformed nickel are influenced by operating variables including pH, temperature, and cathode current density. In an exemplary embodiment, the pH of the electroforming solution 12 is between about 3.9 and about 4.2. At a pH of greater than about 4.2, surface flaws such as gas pitting increase. Also, internal stress increases and interferes with parting of the electroformed element 14 from the mold 10. At a pH of less than about 3.5, the metallic surface of the mold 10 can become activated, especially when chromium plated molds 10 are employed, thereby causing the electroformed metal to adhere to the chromium plating. Low pH also results in lower tensile strength. The pH level may be maintained by the addition of an acid such as sulfamic acid, when necessary. Control of the pH range may also be assisted by the addition of a buffering agent such as boric acid within a range of about 4 oz/gal (30 g/l) to about 5 oz/gal (37.5 g/l). In an exemplary embodiment, a current density of about 15-25 ASF (amps per square foot) is provided to electroforming solution 12 by a power supply and rectifier.

The constituents of the electroforming solution and relatively small amounts of metallic impurities can also affect mechanical properties of the electroformed element 14. The properties are interrelated and steps taken to increase the hardness of the deposit usually increase its strength and lower its ductility. The refinement of crystal structure, for example by the use of organic additives, is accompanied by increased hardness and tensile strength and reduced ductility. Typical properties of electroformed elements 14 from various additive-free electroforming baths are included in Table 1.

Electroformed elements 14 from these types of electroforming solutions 12 are affected differently by the same variables. For example, in the Watts solution, tensile strength is relatively independent of plating solution temperature, pH and cathode current density; it increases with increasing nickel and chloride in solution. In the sulfamate solution, tensile strength decreases with increasing temperature to 50° C., increases with increasing pH, and decreases with increasing cathode current density; it decreases slightly with increasing nickel and chloride in solution. The operating variables, as well as the specific constituents, affect the properties of electroformed element 14.

In addition, the mechanical properties, especially the per cent elongation or ductility, are affected by the thickness of the electroformed element 14. The ductility increases with increasing nickel thickness up to about 250 micrometers, after which it becomes relatively constant. The properties of nickel electroformed from sulfamate solutions can also be affected by uncontrolled anode behavior, which results in the oxidation of the sulfamate anion. The oxidation products can lower the internal stress and increase the sulfur content of the deposits.

Oxidation products formed at an insoluble platinum anode in sulfamate solutions lower internal stress and result in the codeposition of sulfur. The codeposition of small amounts of sulfur affects the mechanical properties of electroformed nickel, especially at high temperatures. Thus, it is important to control the anode behavior to achieve consistent results in electroforming from sulfamate solutions.

The variation of the thickness of the metal deposited at various points on the surface of a mold is related to current distribution. Recessed areas will receive less current; areas that project from the surface will receive higher levels of current. Thus, the current density and the rate of metal deposition will be lower in recessed areas than at areas that project from the surface. The result is that metal distribution may be non-uniform, with the deposit being relatively thin in recessed areas and relatively thick on projections. To enhance uniformity, shielding may be used on the tanks.

In an exemplary embodiment, electroformed element 14 is deposited at a rate of about 1 mil/hour. In one embodiment, electroformed element 14 is allowed to form for a duration of about 70-90 hours, resulting in a thickness of electroformed element 14 of about 70-90 mils (1.78-2.29 mm).

Some electroforming solutions 12 are less sensitive then others to variations in current density. The capability of a electroforming solution 12 to deposit uniformly thick deposits despite variations in current density on the surface of an electroformed element 14 is measured by its throwing power. Throwing power is the relationship between metal distribution and the variables of conductivity, polarization, current efficiency, and geometry. Studies of the throwing power of nickel plating solutions 12 suggest that throwing power can be improved by reducing current density, by increasing the distance between anode and cathode, and by increasing the pH, temperature, and metal content of the bath. All-chloride nickel plating solutions (which are generally not used for electroforming because of the high internal stress of the deposits) have better throwing power than Watts solutions. Sulfamate solutions are better than Watts solutions but not as good as the all-chloride solutions.

An electroformer will usually select a nickel process based on the mechanical and physical properties specified, rather than throwing power. Metal distribution is then improved by proper racking and by the use of thieves, shields, and/or conforming or auxiliary anodes. The use of these processing aids makes it possible to control metal distribution and obtain relatively uniform deposits. Although these techniques are optimized by trial and error, simulation of the electroforming operation, combined with the determination of cathode potential profiles, can facilitate the design and placement of shields and auxiliary anodes. Computer software is available to help improve metal distribution at the cathode.

The control of internal stress is important in electroforming. Internal stress refers to forces created within an electrodeposit as a result of the electrocrystallization process and/or the codeposition of impurities such as hydrogen, sulfur and other elements. The forces are either tensile/contractile or compressive/expansive in nature; rarely are electrodeposits free of some degree of internal stress. Excessive tensile or compressive stress can cause the following problems: 1) distortion of the electroformed element when it is separated from the mold; 2) difficulty of separating the electroformed element from the mold; 3) curling, peeling or separation of the electroformed element prematurely from the mold; and 4) buckling and blistering of the deposit, which is usually indicative of high compressive stress.

Internal stress is influenced by the nature and composition of the nickel plating solution (see Table 2).

TABLE 2

Typical Values of Internal Stress for Nickel Electroforming Solutions

| Electroforming Solution | Internal Stress, MPa |
|---|---|
| Watts | 110 to 210 |
| Watts with hydrogen peroxide | 275 or higher |
| All-Chloride | 205 to 310 |
| Fluoborate | 100 to 175 |
| Fluoborate with hydrogen peroxide | 100 to 175 |
| Sulfamate, no chloride | 0 to 55 |
| Sulfamate, with chloride | 55 to 85 |
| All Sulfate | 110 to 140 |

The all-chloride solution produces deposits with the highest internal stresses. Nickel sulfamate solutions without chlorides produce deposits with the lowest internal stresses. As discussed, organic additives can be used to control internal stress of electrodeposited nickel, but since these additives invariably introduce sulfur, they should be used with caution and due consideration. Sulfur codeposited with nickel increases its hardness and strength and reduces ductility. Sulfur affects the high temperature properties adversely, and nickel deposits with sulfur cannot be heated above 200° C. without becoming embrittled. The codeposition of small amounts of manganese has been shown to prevent embrittlement of sulfur-containing nickel electrodeposits and allows heating above that temperature. The concentrated nickel sulfamate process discussed above can be operated at high current densities to yield deposits with very low or zero internal stresses, the techniques being shown to be effective with nickel as well as nickel-cobalt alloy electroforming. Internal stress is also controlled by specifying the electrolyte and maintaining its purity. Control of current density and the other operating variables is also important.

Roughness in the form of nodules, nuggets and trees, for example, may form. These become high current density areas, and the larger they get, the faster they grow and the more they rob surrounding areas of deposit. As a consequence, the filtration rates used in electroforming may be high in an effort to prevent roughness; the rates may amount to passing the entire solution through a filter one or more times an hour. In an exemplary embodiment, in-line filtration with a 5 micron filter is used, with a rate of 30 GPM.

Sources of roughness include airborne dirt. It is sound electroforming practice to keep the plating area clean by vacuum cleaning and to supply the plating room with filtered air while keeping the room slightly pressurized. These precautions are especially suitable when the plating tank has an exhaust system that draws air across the bath.

Anode particles may also cause roughness and are controlled by means of anode bags and diaphragms. Higher filtration rates and cathode agitation may also be beneficial. The crystallization of bath chemicals on anode bags, tank walls and super-structures which may form at low temperatures or because of inadequate solution agitation may cause roughness problems when these particles fall or are brushed into the solution. The crystallized salts tend to dissolve slowly and may become attached to the cathode. Accumulated salts should be removed carefully or washed away when the bath is not in use. Deionized water is used in exemplary embodiments to make up the plating and rinsing solutions to avoid the formation of particles from precipitation of hard water constituents.

In order to maintain a continuous steady state operation, the electroforming solution 12 can be continuously circulated through a closed solution treating loop. This loop may comprise a series of processing stations which maintain a steady state composition of the solution 12, regulate the temperature of the solution and remove any impurities therefrom. In an exemplary embodiment, a pump circulates electroforming solution 12 at a rate of about 30 GPM (gallons per minute).

Agitation may be employed to control burning and pitting at high current density sites. However, solution agitation may induce roughness unless the solution is kept clean by using a high filtration rate.

Figure 1C:
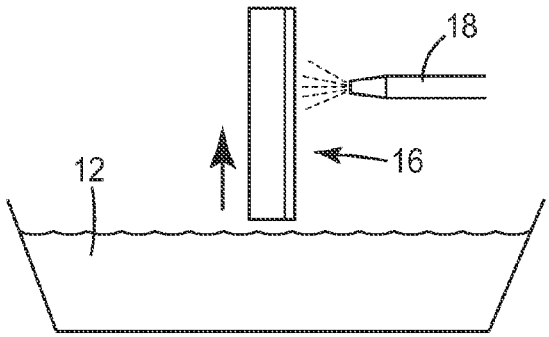
FIG. 1C is a schematic view of the composite electroformed element and mold assembly being removed from the electroforming solution and rinsed with deionized water maintained at the same temperature as the electroforming solution.

FIG. 1C shows a step of rinsing composite assembly 16 with a fluid, which in an exemplary embodiment is de-ionized water from nozzle 18, that is maintained at the same temperature as electroforming solution 12, which is 55° C. in an exemplary embodiment. Therefore, composite assembly 16 remains in the same stress state as it possesses in electroforming solution 12, which is ideally near zero stress.

Figure 1D:
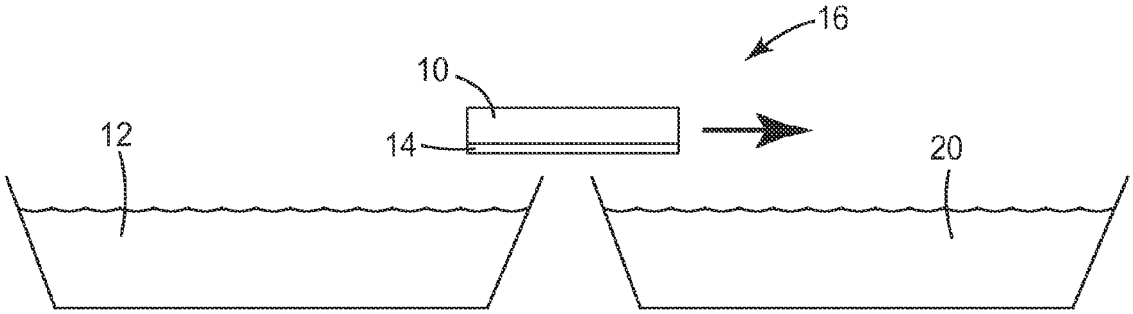
FIG. 1D is a schematic view of the transfer of the composite assembly from the electroforming solution bath to a water bath held at the same temperature.

FIG. 1D is a schematic view of the transfer of the composite assembly 16 from a bath of plating solution 12 to a bath of fluid, which in one embodiment is water 20, held at the same temperature. Handling and transfer of composite assembly 16 can be achieved by conventional handling and conveying means. In an exemplary embodiment, after rinsing, composite assembly 16 is flipped before transfer to a bath of deionized water 20, so that electroformed element 14 is below mold 10. In an exemplary embodiment, about 7-8 minutes elapse between the time that composite assembly 16 is immersed in electroforming solution 12 and the time when composite assembly 16 is immersed in de-ionized water 20. In an exemplary embodiment, composite assembly 16 is rinsed with temperature controlled water maintained at 55° C. for the entire duration of this transfer. The rinse of deionized water from nozzle 18 not only maintains the temperature of composite assembly 16 at the electroplating temperature, but also aids in rinsing electroforming solution 12 off composite assembly 16.

Figure 1E:
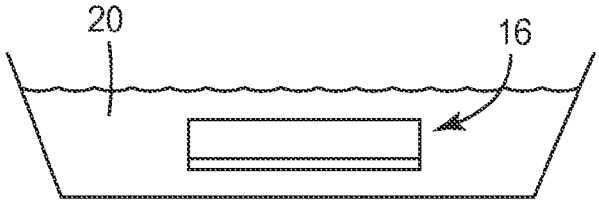
FIG. 1E is a schematic sectional view of the composite assembly in a water bath that is maintained at the same temperature as the plating solution bath.
Figure 1F:
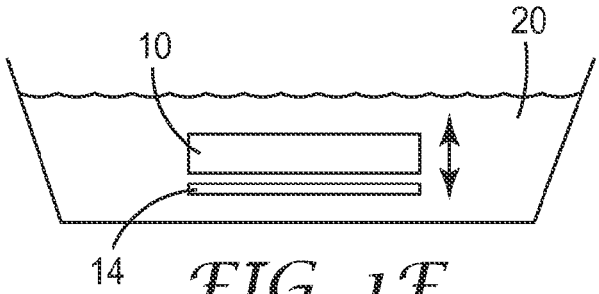
FIG. 1F is a schematic sectional view illustrating separation of the electroformed element from the mold in the water bath.

FIG. 1E shows composite assembly 16 in a bath of deionized water 20, which is maintained at the same temperature as electroforming solution 12, which in an exemplary embodiment is about 55° C. FIG. 1F is a schematic sectional view illustrating separation of the electroformed element 14 from the mold 10 in bath of deionized water 20. An exemplary separation method is explained with reference to FIGS. 2-5. Because deionized water 20 is held at the same temperature as electroforming solution 12, mold 10 and electroformed element 14 are in the same stress state as when electroformed element 14 was deposited on mold 10. Thus, electroformed element 14 may be gradually removed from mold 10 without concern as to how much time is required for the separation.

Figure 1G:
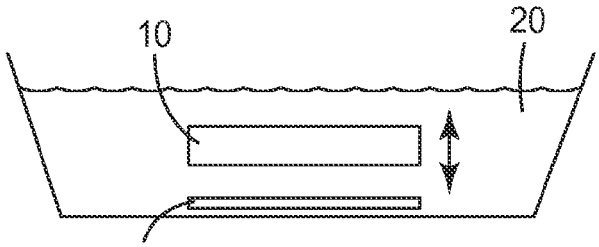
FIG. 1G is a schematic sectional view of the electroformed element separated from the mold.
Figure 1H:
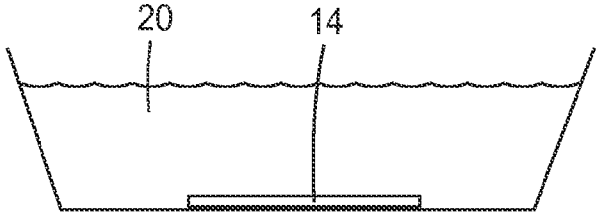
FIG. 1H is a schematic sectional view of the electroformed element remaining in the water bath after removal of the mold.

FIG. 1G is a schematic sectional view of the electroformed element 14 separated from the mold 10. As shown in FIG. 1H, after separation, mold 10 is removed from deionized water 20, leaving electroformed element 14, which is then available for further processing. Because composite assembly 16 was flipped during transfer from electroforming solution 12 to deionized water 20, as illustrated in FIG. 1D, it is a simple matter to remove mold 10 without further disturbing electroformed element 14.

Figure 2:
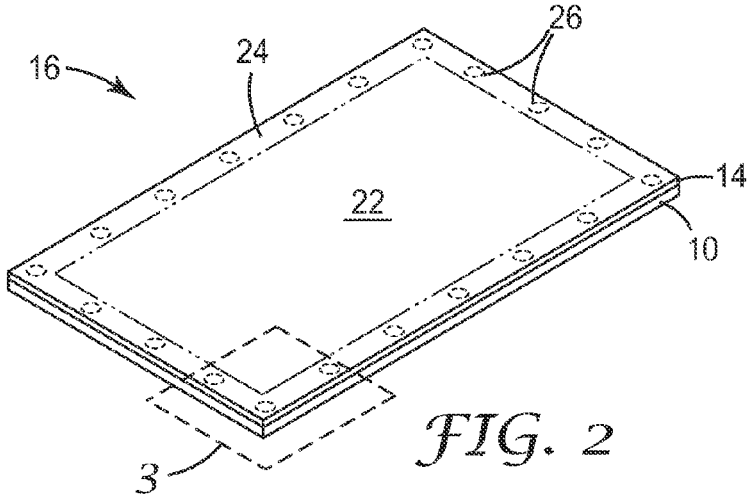
FIG. 2 is perspective view of a flat mold with a microtextured surface electroformed thereon, in accordance with an exemplary embodiment of the present disclosure.

FIG. 2 is perspective view of a flat mold 10 with a microtextured surface 22 electroformed thereon, in accordance with an exemplary embodiment of the present disclosure. In an exemplary embodiment, microtextured surface 22 includes a plurality of micron-scale structures, sometimes referred to microstructured features. Such microstructured features can include any type, number, shape and dimension of micron-scale structures on or indenting into a surface of an article.

Figure 4A:
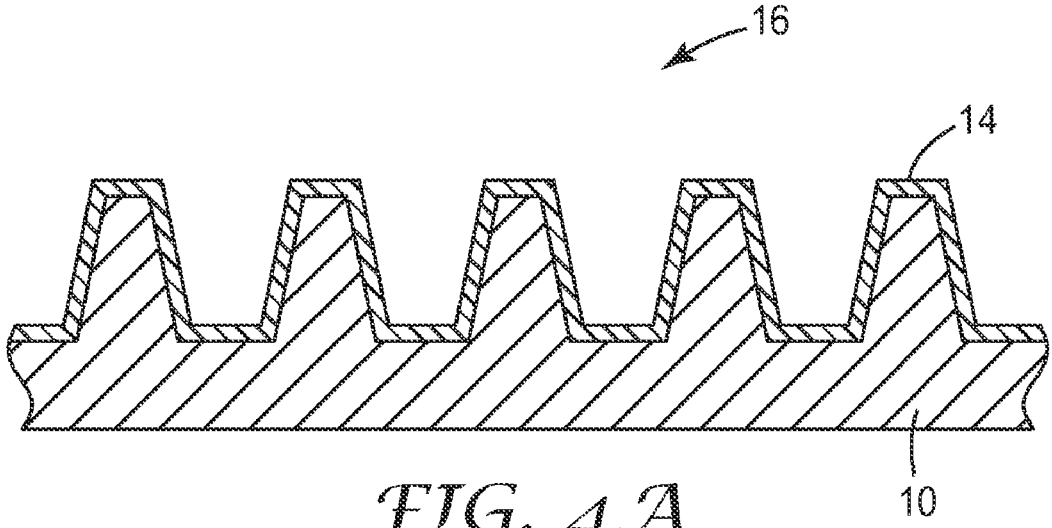
FIG. 4A is a partial cross-sectional view of the electroformed element and mold composite of FIG. 3, taken along line 4-4.
Figure 4B:
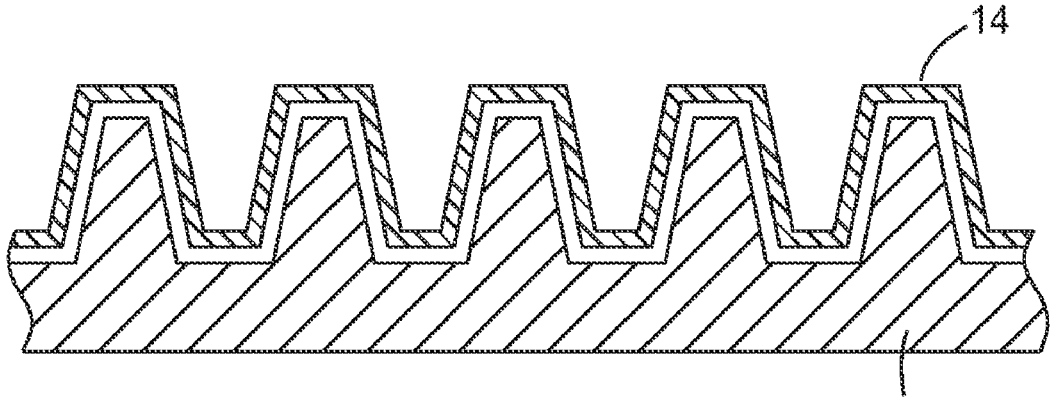
FIG. 4B is a view similar to FIG. 4A, showing the separation of the electroformed element from the mold.
Figure 5:
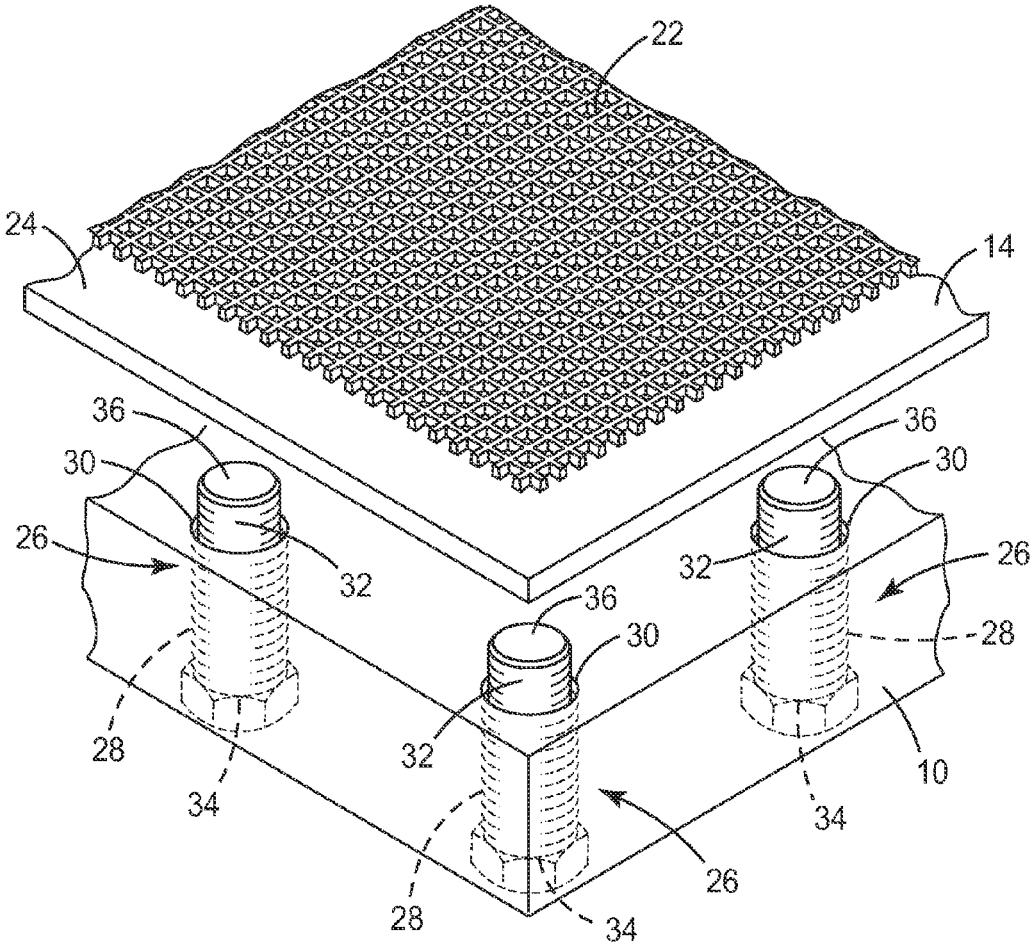
FIG. 5 is a view similar to FIG. 3, showing separation of the electroformed element from the mold and the mechanism used to separate the electroformed element from the mold.

For ease of description, in FIGS. 2-5, the step of separating electroformed element 14 from mold 10 will be shown with electroformed element 14 facing up, although it is understood that in the separation process, electroformed element 14 may be facing down or oriented otherwise. Composite assembly 16 includes microtextured surface 22 surrounded by border 24. Separation mechanisms 26, shown in phantom because they are not visible from the top of electroformed element 14, are placed within border 24 in the illustrated embodiment. In one embodiment, composite assembly 16 is about 60 inches long on one side and about 35-40 inches long on a perpendicular side. In some embodiments, separation mechanisms 26, described further with reference to FIG. 5, are placed about every 4-5 inches about border 24. In one embodiment, border 24 is about 2 inches wide and is disposed along a perimeter of composite assembly 16. After separation of electroformed element 14 from mold 10, border 24 may be trimmed off.

Figure 3:
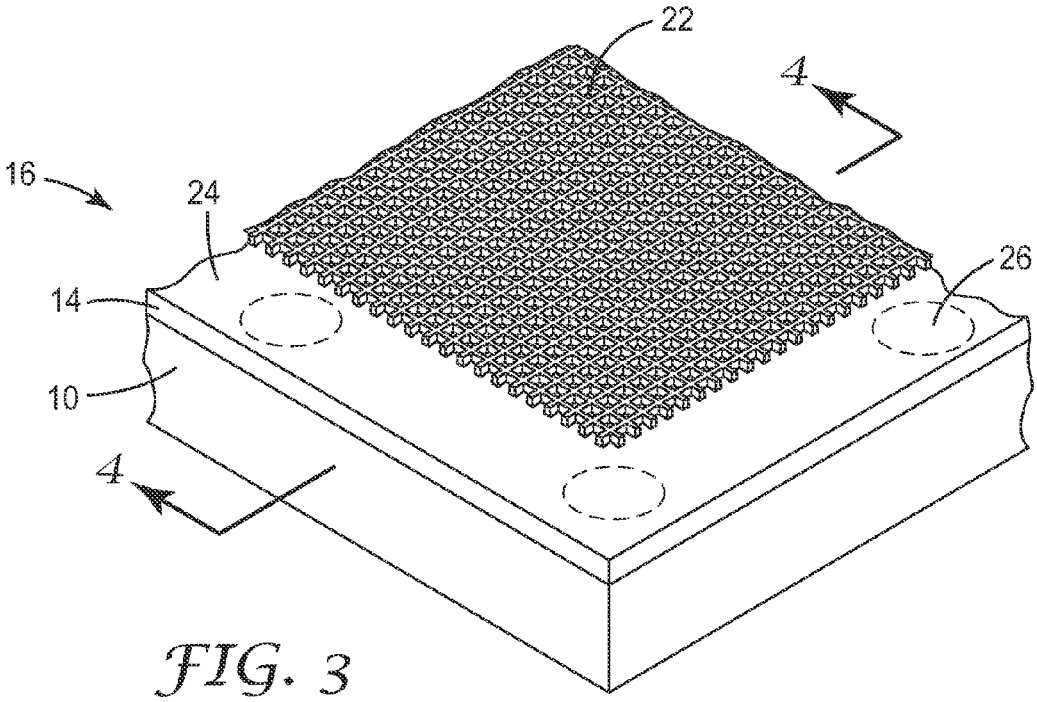
FIG. 3 is an enlarged view of the dotted portion 3 of FIG. 2.

FIG. 3 is an enlarged view of the dotted portion 3 of FIG. 2. In an exemplary embodiment, microtextured surface 22 has a fine structure pattern with ribs. In an exemplary embodiment, each rib protrusion has a height of about 210 micrometers (for both longitudinal and transverse protrusion portions), a top width of 110 micrometers and a bottom width of 200 micrometers for the longitudinal protrusion portion, a top width of 40 micrometers and a bottom width of 200 micrometers for the transverse protrusion portion, and a pitch (distance between centers of adjacent protrusion portions) of 300 micrometers for the longitudinal protrusion portion and a pitch of 510 micrometers for the transverse protrusion portion. Other embodiments exhibit a rib height between about 150 and 300 micrometers, a rib pitch between about 150 and 800 micrometers, and a rib width between about 40 and 200 micrometers.

FIG. 4A is a partial cross-sectional view of the composite assembly 16 of FIG. 3, taken along line 4-4. FIG. 4B is similar to FIG. 4A, showing the separation of the electroformed element 14 from the mold 10. The separation of electroformed element 14 from mold 10 is accomplished in an exemplary embodiment by separation mechanisms 26 illustrated in FIG. 5.

FIG. 5 is similar to FIG. 3, showing the mechanism used to separate the electroformed element 14 from the mold 10. In an exemplary embodiment, each separation mechanism 26 includes a threaded bore 28 having an orifice 30 on a top surface of mold 10 and a screw or screw 32 for threadably engaging bore 28. In one process, before mold 10 is placed in electroforming solution 12, each orifice 30 is masked so that electroformed metal is not deposited within threaded bore 28. Orifices 34 on a bottom surface of mold 10 may also be similarly masked. The masking of orifices 30 and 34 may be accomplished by conventional means, such as with use of a masking adhesive tape. Alternatively, a backing layer, not shown, may be used to mask all of the orifices 34. Before separation of composite assembly 16, the backing layer may be removed to expose orifices 34.

After electroformed element 14 is deposited on mold 10, the composite assembly 16 is separated in the step of FIG. 1F. In an exemplary embodiment, this is accomplished by inserting a screw 32 in each orifice 34. Each screw 32 is advanced until it contacts a bottom surface of electroformed element 14 at orifice 30. Thereafter, the screws 32 are incrementally advanced to gradually push electroformed element 14 off the surface of mold 10. Orifices 30 are preferably masked in a manner that does not impede the separation of electroformed element 14 from mold 10. Advancement of the plurality of screws 32 may be accomplished simultaneously or sequentially. If accomplished sequentially, in an exemplary embodiment, a first screw is turned a small amount. Then a neighboring screw is turned a small amount until all screws have been turned that same amount. Then, all screws are turned in a second incremental step to gradually and evenly separate electroformed element 14 from mold 10.

Because a plurality of separation mechanisms 26 are used, evenly distributed force is generated because of the multiple points of separation. Because the screws 32 are slowly advanced in small increments, separation mechanisms 26 result in a straight lifting of electroformed element 14 from mold 10. This helps to eliminate damage that may incur from unwanted forces caused by peeling, thermal expansion or other methods of separation. As ends 36 of screws 32 press on a bottom surface of electroformed element 14 and protrude between electroformed element 14 and mold 10, ends 36 maintain separation therebetween and act as spacers so that the microstructured elements of microtextured surface 22 do not interfere with or scrape against the corresponding structural elements of mold 10. Electroformed element 14 preferably possesses flexibility, as this will allow for its separation from mold 10 even if the formed structures overhang some of the mold structures.

Electroformed element 14 is thereafter removed from the bath of deionized water 20. In an exemplary embodiment, electroformed element 14 can be used as a mold to make products having corresponding and inverted microstructured features for use in a variety of applications. Examples of suitable products include optical films, abrasive films, adhesive films, friction control films, molds for making a plasma display panel, molds for injection molding, mechanical fasteners having self-mating profiles, microfluidic articles and other microstructured components. Such films are typically made using a coating process in which a polymeric material in a viscous state is applied to the electroformed element 14, allowed to at least partially cure, and then removed. A film composed of the cured material will have the opposite structures than those of electroformed element 14. For example, an indentation (negative feature) in electroformed element 14 results in a protrusion (positive feature) in a resulting film.

Figure 6:
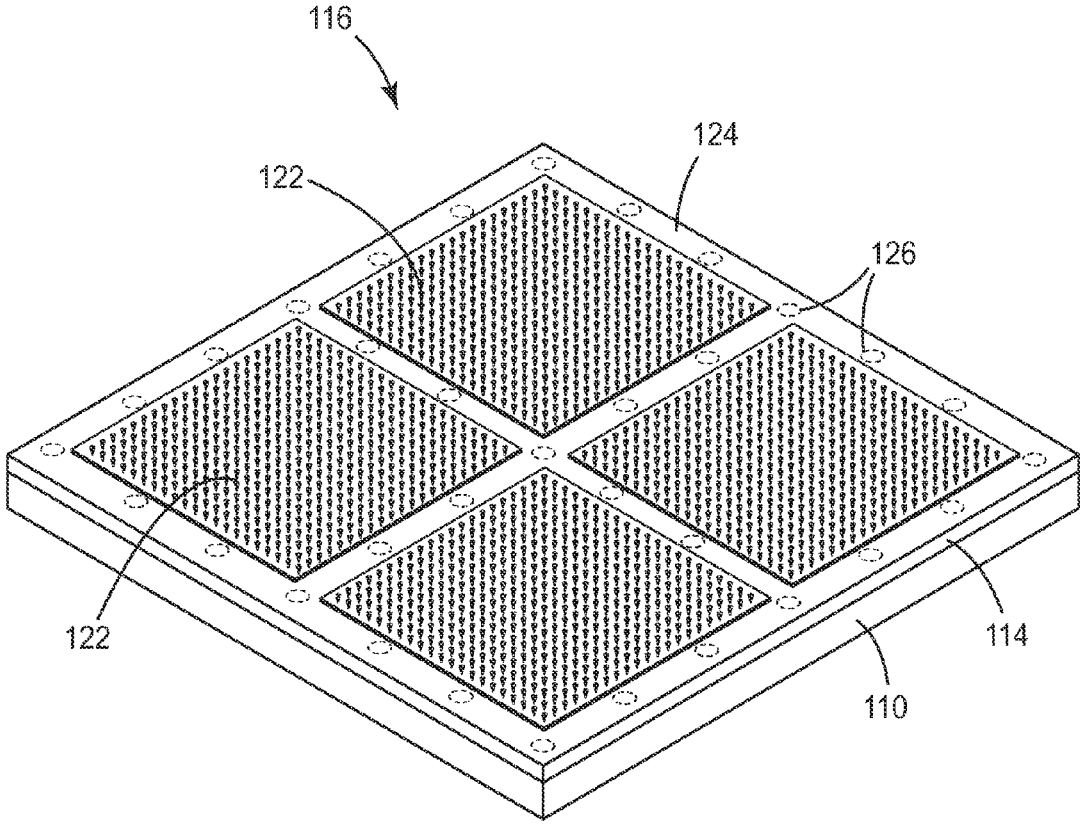
FIG. 6 is a perspective view of another exemplary embodiment, showing arrangement of the separation mechanisms with respect to a plurality of arrays of microstructured elements.

FIG. 6 is a perspective view of another exemplary embodiment, showing arrangement of the separation mechanisms 26 with respect to a plurality of arrays 122 of microstructured elements. Composite assembly 116, formed of mold 110 and electroformed element 114, includes a plurality of microneedle arrays 122, separated by border 124. Border 124 extends between the microneedle arrays 122, as well as around a perimeter of composite assembly 116. Separation mechanisms 126 are spaced on border 124 around each of the microneedle arrays 122. Exemplary microneedle devices and arrays are described in U.S. Patent Applications 2007/0191761 and 2005/0187521, both assigned to Applicant and both hereby incorporated by reference. It is contemplated that other configurations of microstructured elements may also be used, with a plurality of separation mechanisms 126 distributed in and around such arrays.

Although the devices and processes disclosed herein have been described with respect to several embodiments, workers skilled in the art will recognize that changes may be made in form and detail without departing from the spirit and scope of the present disclosure.

What is claimed is:

1. A method comprising:

placing a conductive mold in a first bath of electroforming solution, the solution comprising metal and having a selected temperature;

providing a current to the electroforming solution so that metal deposits onto the mold, thereby forming an electroformed element on the mold, the electroformed element and the mold being a composite assembly;

removing the composite assembly from the electroforming solution;

transferring the composite assembly to a second bath having the same selected temperature; and separating the electroformed element from the mold while the composite assembly is in the second bath.

2. The method of claim 1 wherein the second bath comprises deionized water.

3. The method of claim 1 further comprising rinsing the composite assembly with a fluid having the same selected temperature prior to the transfer step.

4. The method of claim 3 wherein the fluid comprises deionized water.

5. The method of claim 3 wherein the rinsing comprises spraying.

6. The method of claim 1 wherein the step of forming an electroformed element on the mold comprises forming the electroformed element on top of the mold.

7. The method of claim 6 wherein the transfer step further comprises flipping the composite assembly so that the electroformed element is under the mold in the second bath of water.

8. The method of claim 1 wherein the mold comprises a plurality of bores, the method further comprising masking off each of the plurality of bores to prevent metal deposition therein.

9. The method of claim 8 wherein a plurality of bores are provided on a border disposed about a perimeter of the mold.

10. The method of claim 9 wherein a plurality of bores are further provided between arrays of structured elements on the mold.

11. The method of claim 1 wherein the separating step comprises gradually advancing a plurality of separation mechanisms to push the electroformed element away from the mold.

12. The method of claim 11 wherein the plurality of separation mechanisms are advanced simultaneously.

13. The method of claim 11 wherein the plurality of separation mechanisms are advanced serially.

14. The method of claim 11 wherein a separation mechanism comprises a screw.

15. The method of claim 1 wherein the selected temperature is between 46° C. and 60° C.

16. The method of claim 1 wherein the selected temperature is about 55° C.

17. The method of claim 1 wherein the metal is nickel.

18. A method comprising:

providing a conductive mold comprising a plurality of bores and masking off each of the plurality of bores;

placing the mold in a first bath of electroforming solution, the solution comprising metal and having a selected temperature;

providing a current to the electroforming solution so that metal deposits onto the mold, thereby forming an electroformed element on the mold, the electroformed element and the mold being a composite assembly;

removing the composite assembly from the electroforming solution;

spraying the composite assembly with a fluid having the same selected temperature;

transferring the composite assembly to a second bath of fluid having the same selected temperature; and separating the electroformed element from the mold while the composite assembly is in the second bath, wherein the separating step comprises gradually advancing a plurality of separation mechanisms through at least some of the plurality of bores in the mold to push the electroformed element away from the mold.

19. The method of claim 18 wherein the separating step further comprises advancing one of the separation mechanisms through each one of the bores in the mold.

20. The method of claim 18 wherein the step of forming the electroformed element on the mold comprises forming the electroformed element on top of the mold, and wherein the transfer step further comprises flipping the composite assembly so that the electroformed element is under the mold the second bath of fluid.

* * * * *